United States Patent [19]

Shinoda

[11] 4,021,162

[45] May 3, 1977

[54] VANE-TYPE ROTARY MACHINES

[75] Inventor: Kazuo Shinoda, Gifu, Japan

[73] Assignee: Ishikawajima-Harima Jukogyo Kabushiki Kaisha, Ote, Japan

[22] Filed: Apr. 22, 1975

[21] Appl. No.: 570,490

[52] U.S. Cl. ..... 418/82; 418/258

[51] Int. Cl.[2] ..... F01C 1/00; F01C 21/00; F03C 3/00; F04C 1/00

[58] Field of Search ..... 418/253, 257, 258, 265, 418/267, 82

[56] References Cited

UNITED STATES PATENTS

| | | | |
|---|---|---|---|
| 138,744 | 5/1873 | Elsaesser | 418/258 |
| 1,033,985 | 7/1912 | Bucher | 418/258 |
| 1,284,083 | 11/1918 | Flinn | 418/258 |
| 1,303,745 | 5/1919 | Vogan | 418/258 |
| 1,799,539 | 4/1931 | Smith | 418/257 |
| 2,569,185 | 9/1951 | McKibben et al. | 418/258 |
| 2,641,193 | 6/1953 | Klessig | 418/258 |
| 2,641,194 | 6/1953 | Jones et al. | 418/258 |
| 2,809,595 | 10/1957 | Adams et al. | 418/82 |
| 2,853,951 | 9/1958 | Graham et al. | 418/258 |

*Primary Examiner*—John J. Vrablik

*Attorney, Agent, or Firm*—Scrivener Parker Scrivener & Clarke

[57] ABSTRACT

The invention discloses a vane-type rotary machine of the type in which at any angular position of a rotor which has a plurality of vanes slidably fitted into the radial vane slots and is rotated in a cam ring, the satisfactory contact of the tip of each vane with the inner surface of the cam ring may be ensured so that the discharge or intake through the ports formed through the side wall of the cam ring may be carried out with maximum efficiency.

10 Claims, 18 Drawing Figures

Fig. 1
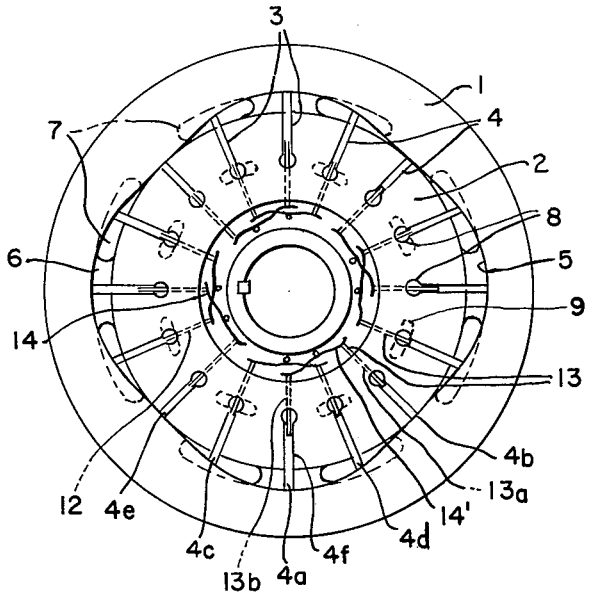
Fig. 2
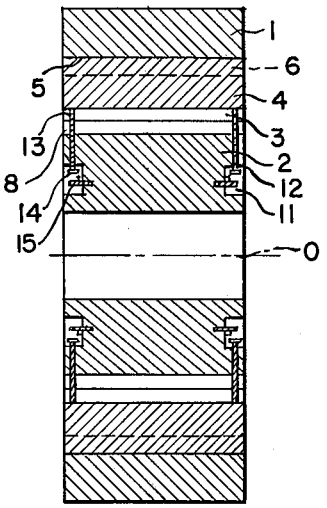
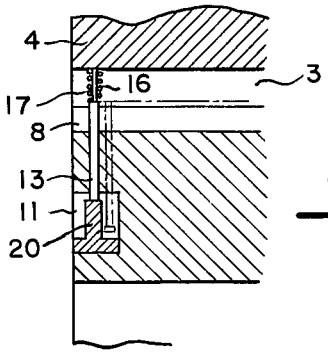
Fig. 4
Fig. 3
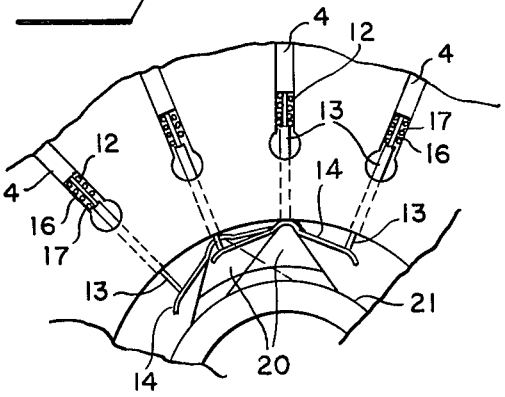
Fig. 5
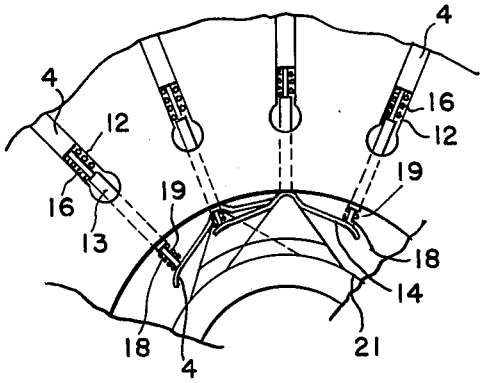

Fig. 6
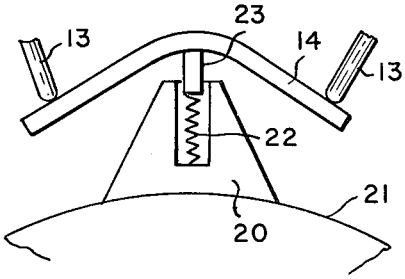
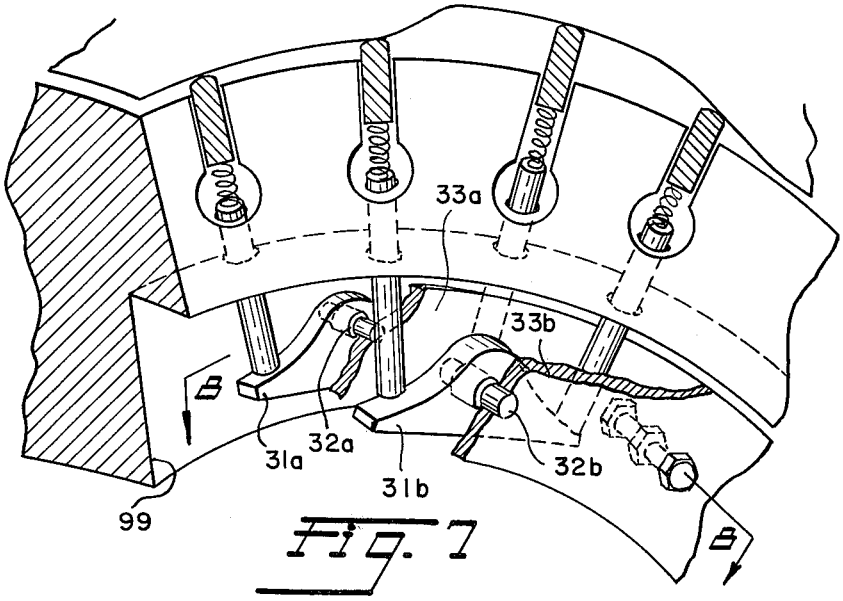
Fig. 7
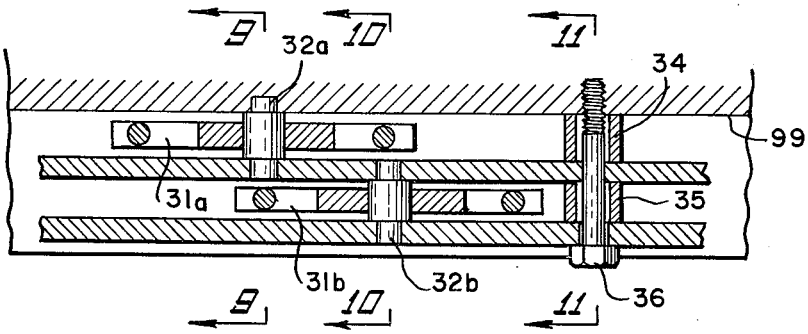
Fig. 8

Fig. 9
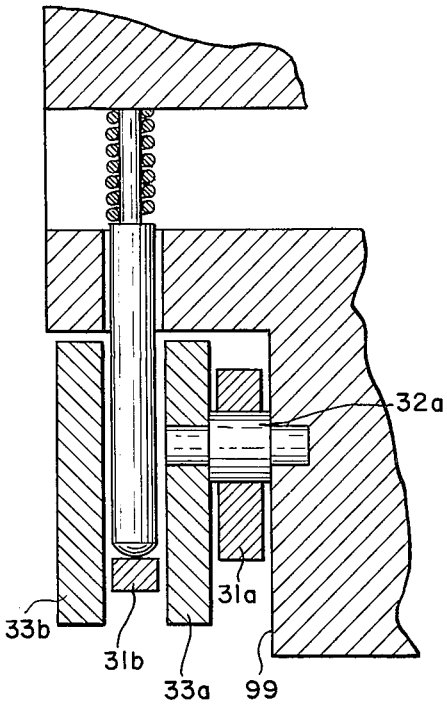
Fig. 10
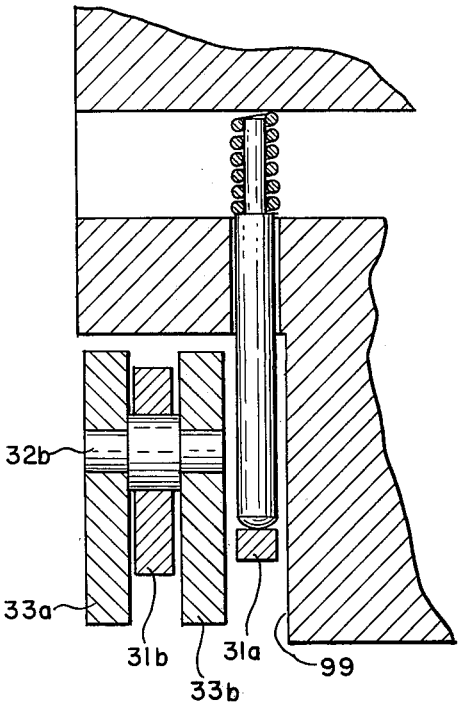
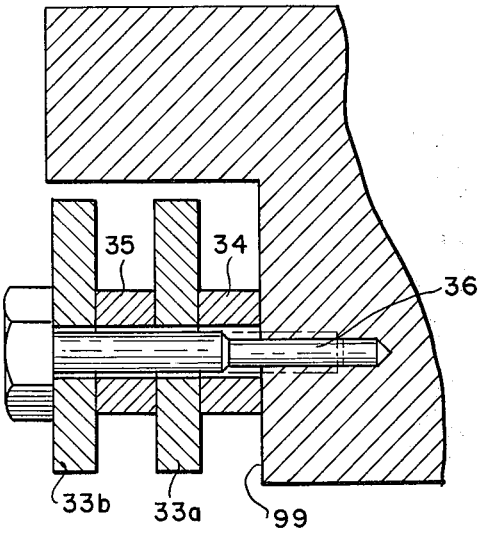
Fig. 11

Fig. 12
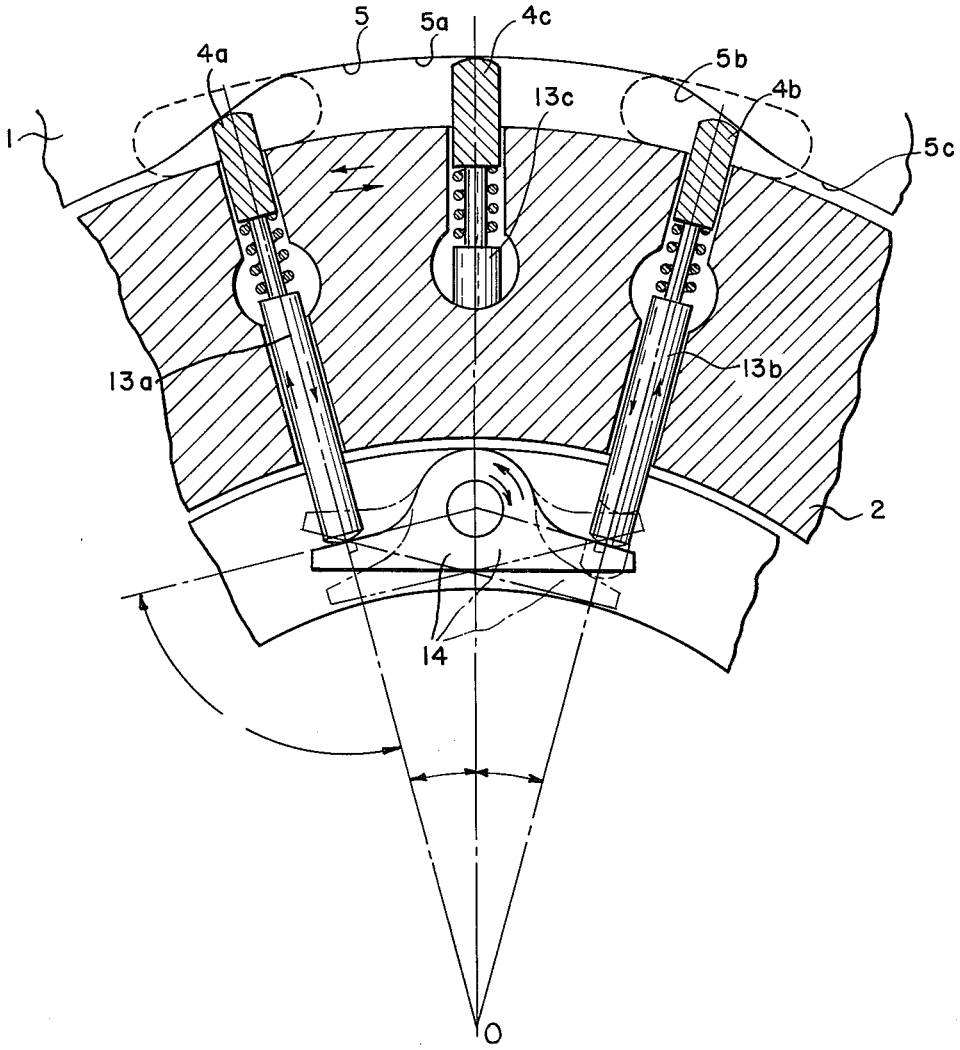
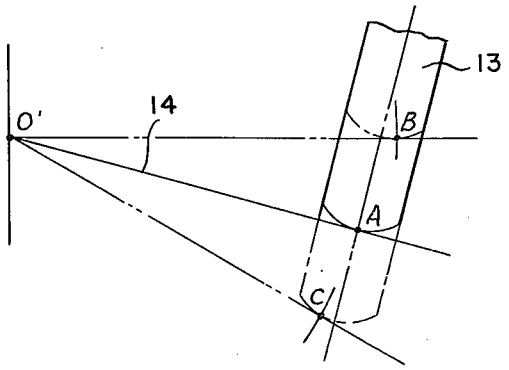
Fig. 13

Fig. 14
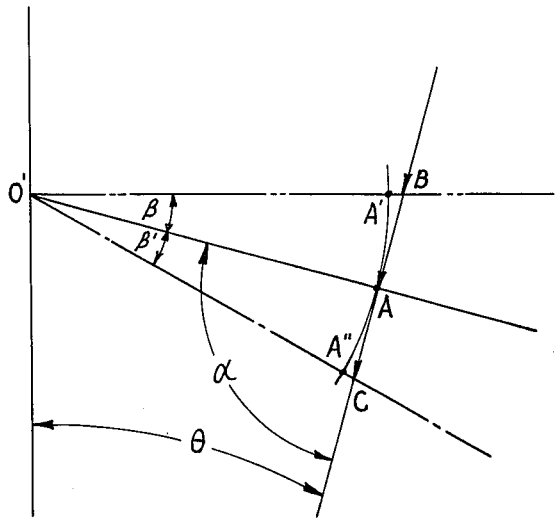
Fig. 15
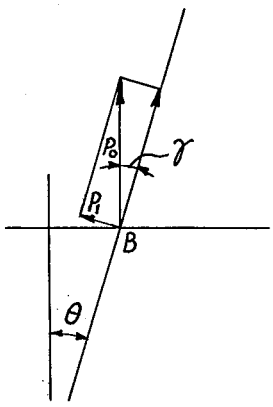
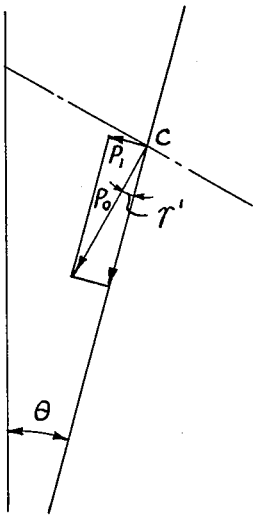
Fig. 16
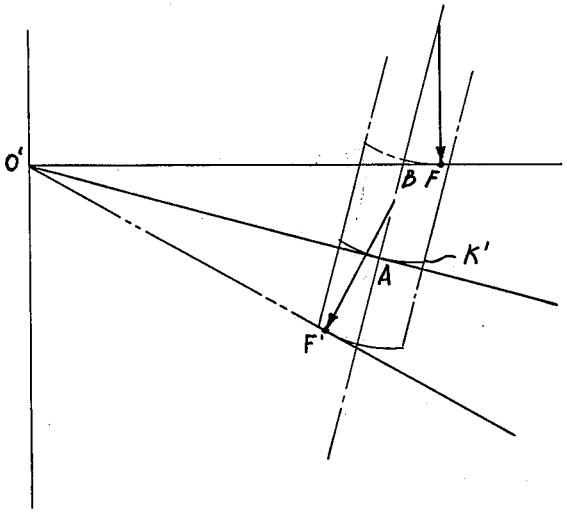
Fig. 17

VANE-TYPE ROTARY MACHINES

DETAILED DESCRIPTION OF THE INVENTION

The present invention relates to generally vane-type rotary machines used as pumps, motors or the like, and more particularly improvements of a mechanism for causing the reciprocal movement of the vanes.

In general, in vane-type pumps or motors, the vanes are reciprocated within the radial vane slots as their tips move in contact with the inner surface of a cam ring. In order to ensure the satisfactory contact of the tip of the vane with the inner surface of the cam ring, a force must be imparted to the vane so that the latter may project outwardly and be pressed against the inner surface. The force required may be produced by utilizing 1. the centrifugal force of the vane itself,
2. the hydraulic pressure acting upon the bottom end of the vane or
3. the mechanical force produced by springs or the like.

However, in low-speed pumps or the motors whose rotational speed changes from a low speed to a high speed, the centrifugal force is too small at a low speed so that the above methods (1) and (2) cannot be employed. Furthermore, when the machine is started, the vanes must be retracted into the vane slots. Therefore, the third method (3) must be employed.

The mechanical method may be classified into various types. In one type, the vanes are directly pushed outwardly by the rocker-arm-shaped springs. More particularly, two vanes which are spaced apart from each other in direct opposition are alternately pushed outwardly by the rocker-arm-shaped spring which makes the seesaw action. This mechanism is very rational, but the oil port at the bottom of each vane slot opens at the spring chamber formed in each side surface of the rotor, and the high hydraulic pressure (the delivary pressure in case of the motor) is introduced into the spring chamber in order to balance the hydraulic pressure acting upon the bottom end of the vane. Because of this high hydraulic pressure acting upon the side plates, the fluid leaks not only from the side surfaces of the rotor but also from the vane slots. Furthermore, the partial unbalance of the top or bottom end of the vane occurs. Therefore, the rocker-arm-shaped spring type is not adapted for use with the high efficiency low-speed high-torque motors, but it may be used only in the small-sized high-speed rotary machines.

In another type, a coiled spring is loaded at the bottom end of the vane so that the spring force may be always transmitted to the vane. However because of the durability of the coiled spring and the ability of the vane following the inner surface of the cam ring, the vane stroke must be limited, and the dimensions of the coiled spring used are also limited depending upon the thickness of the vane. The poor ability of vane following the inner surface of the cam ring and the relatively shorter service life of the coiled spring are much pronounced as the rotational speed is increased.

In a further type, a pair of vanes are alternately pushed outwardly by an arcuate push rod fitted into each side surface of the rotor. However, this type cannot provide the resilient or elastic force, and the gap which cannot be avoided due to the manufacture tolerances must be compensated by the provision of a spring. Furthermore, the machining of the arcuate groove in the side surface of the rotor is complex and difficult, and the leakage through the side surfaces of the rotor is considerably increased.

The present invention was made to overcome the above and other difficulties encountered in the conventional vane-type rotary machines, and has for its object to provide a rational and highly efficient vane pushing mechanism which is very stable, reliable and dependable in operation both at high and low speeds.

The present invention will become apparent from the following description of the preferred embodiments thereof taken in conjunction with the accompanying drawing, in which:

FIG. 1 is a side view of a cam ring and a rotor of a first embodiment of the present invention;

FIG. 2 is a longitudinal sectional view thereof;

FIG. 3 is a fragmentary side view, on enlarged scale, of a second embodiment of the present invention;

FIG. 4 is a longitudinal sectional view thereof; and

FIG. 5 is a fragmentary side view, on enlarged scale, of a third embodiment of the present invention.

FIG. 6 is a schematic diagram of a fourth embodiment of the present invention;

FIG. 7 is a fragmentary perspective view of a fifth embodiment of the present invention;

FIG. 8 is a sectional view taken along the line 8—8 of FIG. 7;

FIG. 9 is a side view looking in the direction indicated by the arrows 9—9 of FIG. 8;

FIG. 10 is a side view looking in the direction indicated by the arrows 10—10 of FIG. 8;

FIG. 11 is a side view looking in the direction indicated by the arrows 11—11 of FIG. 8;

FIG. 12 is a fragmentary sectional view of an sixth embodiment of the present invention;

FIG. 13 is a view used for the explanation of the displacement of the point of contact between a push rod and a seesaw member thereof;

FIG. 14 is a view used for the explanation of the point of contact between the pushing rod and the seesaw member and the angle therebetween;

FIGS. 15 and 16 are views used for the explanation of the forces transmitted therebetween;

FIG. 17 is a view used for the explanation of the range of the displacement of the point of contact therebetween.

Same reference numerals are used to designate similar parts throughout the figures.

FIRST EMBODIMENT, FIGS. 1 AND 2

Figure 18:
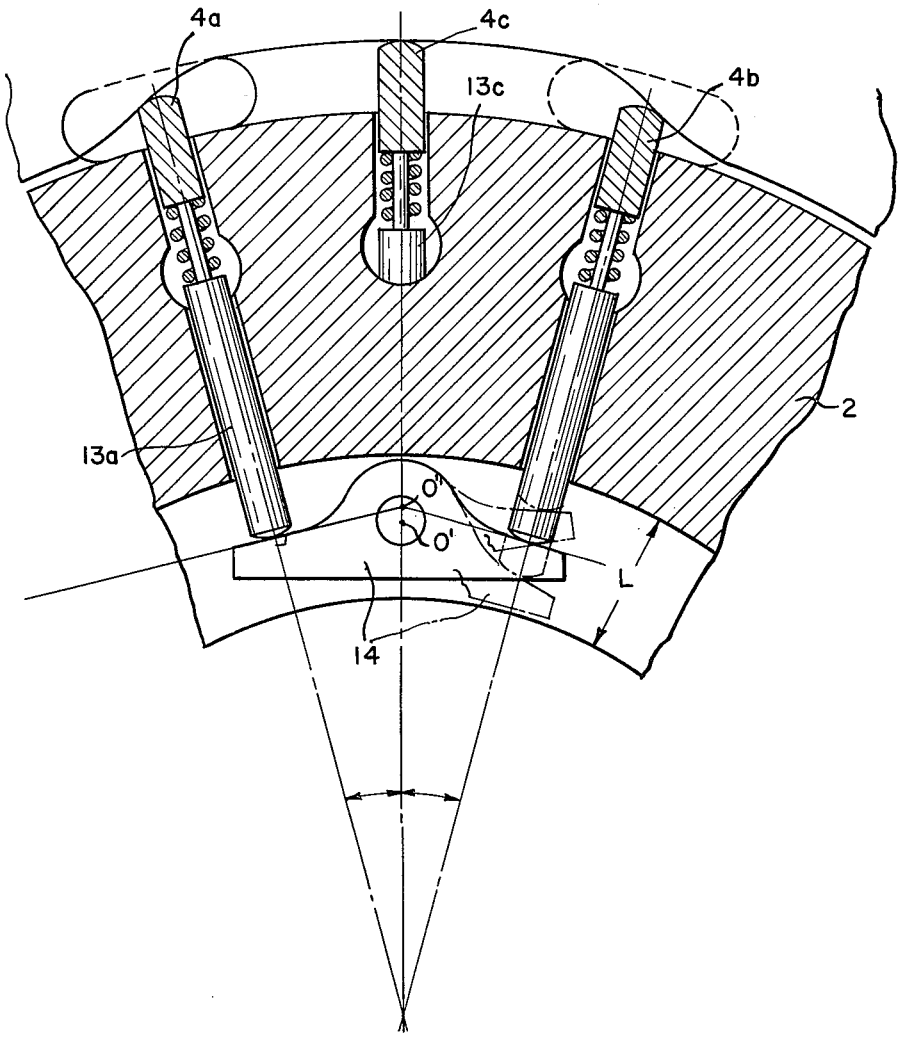
FIG. 18 is a fragmentary sectional view of a variation of the sixth embodiment.

Referring to FIGS. 1 and 2, a rotor 2 which is disposed for rotation within a cam ring 1 has an even number of vane slots 3 equiangularly spaced apart from each other and radially inwardly extended toward the center O of rotation of the rotor 2. A vane 4 is slidably fitted in each of the vane slots 3 in such a way that the tip of the vane 4 has slidable contact with the bore or the inner surface 5 of the cam ring 1 when the rotor 2 is rotated. Intake and discharge ports 7 are formed through a side wall (not shown) and hydraulically communicated with the spaces 6 defined by the inner surface 5 of the cam ring 1 and the adjacent vanes 4 projected out of the vane slots 3. At the bottoms of the vane slots 3 and along a circle whose center is the center O of rotation are formed oil ports 8 through which the fluid flows due to the reciprocal piston movement of the vanes 4, and ports 9 are formed through the side wall (not shown) concentrically of the oil ports 8. An annular groove or housing chamber 11 for housing therein seesaw members 14 to be described hereinafter is formed in each side wall of the rotor 2 concentrically thereof and below the oil ports 8. The annular housing chamber 11 is communicated through a push rod guide hole 12 of a relatively small diameter with each of the oil ports 8. The push rod guide hole 12 is formed coaxially of the center line of the vane slot 3, and its diameter is smaller than the width (almost equal to the thickness of the vane 4) of the vane slot 3. A push rod 13 is relatively closely but slidably fitted into each of the push rod guide holes 12, and the outer end of the push rod 13 is made into engagement with the inner end of the vane 4 while the inner end, into engagement with the seesaw member 14. The seesaw member 14, which is made of a material having a relatively high rigidity, has its center and fulcrum point supported by a supporting pin 15 extended coaxially of the rotor 2 within the housing chamber 11 as best shown in FIG. 2, so that it may make the seesaw motion.

Next the mode of operation of the first embodiment with the above construction will be described. The rotor 2 is rotated in unison with the vanes 4, the push rods 13, the supporting pins 15 and the seesaw members 14 supported by the pins 15. For instance, at a certain angular position the tips or outer ends of the vanes 4*a* and 4*b* are pressed against the inner surface 5 of the cam ring 1 because they are pushed outwardly by the seesaw member 14' through the push rods 13*a* and 13*b*, respectively. As shown in FIG. 1, the inner surface of the cam ring 1 is not circular, but represents a configuration consisting of various curves so that the distance between the center O of rotation and the tip of the vane 4*a* in contact with the inner surface 5 of the cam ring 1 is different from that between the center O and the tip of the vane 4*b*. The seesaw member 14' is provided for compensating the above difference in distance. That is, the seesaw member 14' swings about its center so that its one end moves up to push the vane 4*a* outwardly while its other end is moved down while supporting the vane 4*b* which is pushed inwardly. When the rotor 2 is rotated through a small angle so that the vanes 4*a* and 4*b* are displaced to the positions 4*c* and 4*d*, respectively, the vane 4*a*, which has been projected outwardly at its maximum stroke, is pushed inwardly so that the seesaw member 14' is caused to swing about its center; that is, the supporting pin 15 in the clockwise direction to the equilibrium position at which the distance between the center O of rotation and the tip of the vane 4*a* at the position 4*c* is equal to the distance between the center O of rotation and the tip of the vane 4*b* at the position 4*d*. When the rotor 2 is further rotated through a small angle so that the vanes 4*a* are displaced to the positions 4*e* and the vanes 4*b* are displaced to the positions 4*f*, respectively, the relative position between them is reversed. That is, the vane 4*a* at the position 4*e* is further pushed inwardly while the vane 4*b* at the position 4*f* is further pushed outwardly so that one end of the seesaw member 14' is moved down while the other is moved up. As the rotor 2 is rotated further, the vanes 4*a* and 4*b* cycle the above reciprocal motions within the vane slots 3.

SECOND EMBODIMENT, FIGS. 3 AND 4

FIG. 3 is a fragmentary side view, on enlarged scale, of the second embodiment of the present invention, and FIG. 4 is a longitudinal sectional view thereof. The second embodiment is substantially similar in general construction to the first embodiment described hereinabove with reference to FIGS. 1 and 2 except an impact absorbing arrangement to be described hereinafter. In the first embodiment, it is so arranged that the distance between the point of contact between the tip of the vane 4 and the inner surface 5 of the cam ring 1 and the point of contact between the inner end of the push rod 13 and the seesaw member 14 may be maintained constant regardless of the swinging motion of the seesaw member 14, but it is extremely difficult to maintain the above distance constant in practice because of the manufacture tolerances. As a result, the seesaw member 14 tends to be subjected to excessive forces, and the inner or bottom end of the vane 4 is spaced apart from the outer end of the push rod 13. The second embodiment was made to overcome the above problem. For this purpose, a coiled spring 17 is interposed between the vane 4 and the push rod 13 so as to absorb the abnormal excessive forces or impacts exerted between them due to the unavoidable manufacture tolerances as will be described in detail hereinafter.

Referring still to FIGS. 3 and 4, the outer end portion 16 for a suitable length of the push rod 13 is reduced in diameter, and the coiled spring is fitted over this reduced diameter portion in the space defined by the bottom end of the vane 4, the reduced diameter portion and stepped portion of the push rod 13 and the inner wall of the vane slot 3 so that the impact or excessive force acting upon the vane 4 or push rod 13 may be absorbed. Therefore the constant force is transmitted from the push rod 13 through the coiled spring 17 to the vane 4, and the direct transmission of the force from the vane 4 to the seesaw member 14 may be prevented during the reciprocal movement of the vane 4. That is, the impact or excessive force is absorbed by the coiled spring 17 so that the constant force is transmitted to the seesaw member 14. Therefore the smooth operation of the rotary machine may be ensured.

THIRD EMBODIMENT, FIG. 5

The third embodiment shown in FIG. 5 is substantially similar in general construction to the first embodiment and is also similar to the second embodiment in that the impact or excessive force absorbing arrangement is provided. However, in the third embodiment the outer end of the push rod 13 is made into direct engagement with the bottom end of the vane 4, and the inner portion for a suitable length of the push rod 13 is reduced in diameter and is fitted with a coiled spring 19 between the seesaw member 14 and the stepped portion 18 of the push rod 13. Therefore, the impact or excessive force acting upon the seesaw member 14 or push rod 13 may be absorbed by the coiled spring 19 so that the constant force is transmitted to the seesaw member 14. Thus the smooth rotation of the machine may be ensured.

In a variation of the first embodiment shown in FIG. 1 except that the seesaw members 14 comprise leaf or rod-shaped springs, which are supported by the pins 15 in a manner substantially similar to that described hereinbefore. Since the leaf or rod-shaped spring seesaw member 14 is used, the impact or excessive force acting upon the vane 4 or push rod 13 may be absorbed by the elasticity of the spring so that the manufacture tolerance problem may be overcomed.

FOURTH EMBODIMENT, FIG. 6

The fourth embodiment of the present invention is substantially similar in construction to the first embodiment except that the seesaw member 14 is not supported by the pin 15 but is supported as shown in FIG. 6. A trapezoidal supporting member 20 is securely attached to the bottom wall 21 of the housing chamber 11, and a spring 22 and a spring stop 23 for supporting the seesaw member 14 are inserted into a vertical blind hole drilled into the supporting member 20 from the top thereof. Therefore the seesaw member 14 is resiliently supported so that the impacts or excessive forces exerted thereto may be satisfactorily absorbed as with the second, third, fourth and fifth embodiments described above.

In the first to third embodiments described above, the seesaw member 14 or leaf or rod-shaped spring is supported by the supporting pin 15 for seesaw motion, but it may be directly supported by the triangular supporting member 20 attached to the bottom of the housing chamber 11 as shown in FIGS. 3, 4 and 5.

FIFTH EMBODIMENT, FIGS. 7–11

The fifth embodiment of the present invention is substantially similar in construction to the first embodiment shown in FIGS. 1 and 2 except that the push rods 13 are made of an elastic material. Therefore opposed to the fourth embodiment, it is not required to use elastic materials to manufacture the seesaw members 14. Furthermore, unlike the second and third embodiments, the use of the coiled springs 17 or 19 may be eliminated.

In the vane type rotary machines in accordance with the present invention, the robust supporting mechanism is required in order to receive the reaction forces exerted to the seesaw members from the vanes 4. The fifth embodiment is an example of the robust supporting mechanisms in which the seesaw members are supported by the pins.

Referring to FIGS. 7–11, the seesaw members **31*a* and 31*b* are rotatably supported by pins 32*a* and 32*b*, respectively, so that the pins 32*a* and 32*b* must be, in turn, supported by the strong supporting mechanism. To this end, two supporting plates 33*a* and 33*b* are securely held within the housing chamber 11 with bolts 36 screwed into bolt holes drilled into the side wall 99 of the housing chamber 11. Each bolt 36 is extended through a collar 34 interposed between the plates 33*a* and 33*b* and through a collar 35 placed between the plate 33*a* and the side wall 99 so that the plates 33*a* and 33*b* are spaced apart from each other by a suitable distance and the plate 33*a* is spaced apart from the inner wall 99 by a suitable distance. A pin 32*b* supporting the seesaw member 31*b* has its both ends fitted into holes drilled through the plates 33*a* and 33*b*. In like manner, a pin 32*a* supporting the seesaw member 31*a* has its both ends fitted into holes drilled into the plate 33*a* and the inner wall 99.** Since both ends of the supporting pins are supported, the robust seesaw supporting mechanism may be provided so that the stable operation of the rotary machine may be ensured.

SIXTH EMBODIMENT, FIGS. 12–18

The sixth embodiment of the present invention has its for object to provide the smoother contact between the seesaw members and the push rods which make direct contact with each other as with the first to fifth embodiments except the third embodiment in which the coiled springs are interposed between the seesaw members and the push rods.

Referring first to FIG. 12, as the rotor 2 is rotated, the vanes **4*a*, 4*b* and 4*c* are moved in sequential contact with the large-diameter portion 5*a*, the curved or transition portion 5*b* and the small-diameter portion 5*c* of the cam ring 1, and their contacts with these portions 5*a*, 5*b* and 5*c* are cycled. Therefore, the vanes 4*a*, 4*b* and 4*c* and their corresponding push rods 13*a*, 13*b* and 13*c* are reciprocated so that the seesaw members 14 make the seesaw motion as described hereinbefore. As the seesaw member 14 swings about its fulcrum point, the point of contact between the seesaw member 14 and the push rod 13 changes from the point A to the points B or C as shown in FIG. 13. When the radius of curvature of the contact end of the push rod 13 is negligible and if the push rod 13 is considered as a line, the point of contact between the seesaw member 14 and the push rod 13 changes as shown in FIG. 14. That is, the point of contact changes from B to A, from A to C, from C to A, then from A to B. The displacement of the end of the push rod 13 over the seesaw member 14** between A and B is $\overline{A'B}$ while the displacement between A and C is $\overline{A''C}$. From the functional standpoint, it is desired that these displacements may be made minimum. From the elementary geometry, it is apparent that the condition for making the displacement minimum is that the angle $\alpha=90°$; that is, both the triangles O'AB and O'AC must be right angle. And these triangles are similar to or homologous with the triangle BO'O (where O is the center of the rotor) with its angle BO'O equal to 90°. Hence, $\beta=\beta'=\theta$ so that $\overline{A'B}=\overline{A''C}$ and that the displacements $\overline{A'B}$ and $\overline{A''C}$ are minimum.

Next referring to FIG. 15, the force $P_o$ acting at a right angle from the surface $\overline{O'B}$ of the seesaw member 14 to the push rod may be resolved into two component forces. One component force $P_1$ acts on the end of the push rod as the lateral load (bending force). The component force $P_1=P_o \sin\gamma$ so that the smaller the angle $\gamma$, the smaller the component force $P_1$ becomes. In like manner, at the point C, the smaller the angle $\gamma'$, the smaller the component force $P_1$ as shown in FIG. 16. The component force $P_1$ becomes minimum when $\gamma=\gamma'=\theta$ that is when $\alpha=90°$. Therefore in order to make not only the displacement but also the lateral load minimum, the angle $O'AO=\alpha=90°$. When this condition is satisfied, the most satisfactory seesaw motion can be ensured.

Next referring to FIG. 17, the greater radius of curvature at the contact end of the push rod, the greater the Hertz's contact pressure, but the radius of curvature must be so selected that the points of contact F and F' at the upper and lower ends of the stroke of the push rod 13 will not extend beyond the edge K'.

From the above explanation, the points O' and A for satisfying the condition that the angle $O'AO=90°$ are selected as follows. The point A must be the midpoint between the points F and F'. Since the points F and F' are the points of contact between the push rod and the seesaw member when the former reaches the upper and lower end of the stroke, the point A corresponds to the point of contact when the vane 4 is at the midpoint of its stroke; that is, when the vane 4 is made into contact with the midpoint of the curved or transition portion 5b of the cam. So far the point O' has been described as the center of the pin 15, but sometimes it may be displaced to the point O'' as shown in FIG. 18. When such point O'' which is located outwardly of the point O', the space L of the housing chamber 11 may be advantageously made small, but the condition $\alpha=90°$ must be satisfied.

It is to be understood that the above embodiments are illustrative rather than restrictive and that variations, modifications or alternations may be resorted to without departing from the true spirit of the present invention. For instance, instead of the guide holes 12, radial guide grooves may be formed in one side surface of the rotor 2, and the push rods 13 may be slidably fitted into them. Instead of the annular housing chamber 11, a plurality of recesses for housing the seesaw members 14 may be formed in each side surface of the rotor 2 in suitably angularly spaced apart relationship. The embodiments descirbed above may be used in various combinations, and some of them may be not used in practice.

The vane-type rotary machines with the above constructions in accordance with the present invention have the following features:

I. Opposed to the conventional rocker arm type, the vanes are projected or pushed outwardly by the seesaw members through the push rods which are slidably and closely fitted into the guide holes or grooves so that the oil ports at the bottom of the vane slots may be completely hydraulically disconnected from the annular housing chambers. As a result, the following two advantages may be attained:
   i. The fluid pressure at the oil port may be selected independently of the hydraulic pressure within the housing chamber so that the balance between the pressures at the tip and bottom of the vane may be advantageously attained.
   ii. The hydraulic pressure within the housing chamber may be maintained relatively low so that the pressure acting upon the side wall members of the machine becomes low.
   iii. Because of the advantages described above (i) and (ii), the leakage at various parts may be minimized.
   iv. Because of (iii), a high efficiency motor or pump may become feasible, and the rotory machine in accordance with the present invention is particularly advantageous as a low-speed high-torque motor.

II. Opposed to the conventional coil spring type, the present invention employs the seesaw member for causing the reciprocal movement of the vane so that the problems encountered in the conventional coil spring type that the service life of the coil spring is shorter and the satisfactory intimate and slidable contact of the tip of the vane with the bore or the inner surface of the cam ring cannot be ensured, may be overcome. The problems of the conventional coil spring type becomes more pronounced with the increase in rotational speed, but the high speed operation of the vane-type rotary machines of the present invention may be ensured.

III. Opposed to the conventional arcuate-shaped push rod type, machining of the arcuate grooves into which are fitted the push rods may be eliminated so that the manufacturing steps may be simplified and the leakage from the side walls of the rotor due to the existence of the push rods may be prevented.

IV. When the spring seesaw members are not used, the coil spring is interposed between the push rod and the vane or seesaw member so that the impact or excessive force produced due to the manufacture tolerances and acting upon the vane may be absorbed. In the third embodiment, the spring seesaw members may be used so that the impact or excessive force may be absorbed. Therefore, according to the second, third and fourth embodiments of the present invention, the impact or excessive force produced due to the manufacture tolerances may be avoided so that the tip of the vane may be pressed against the inner surface of the cam ring under the constant pressure while it follows the inner surface. In the above three embodiments, the reciprocal movement of the vane is caused mainly by the seesaw member or spring seesaw member, and the coiled spring loaded between the push rod and the vane or the seesaw member is used as an auxiliary means. Therefore, the service life of the springs used in the vane-type rotary machines in accordance with the present invention may be longer than that of the spring members used in any conventional coil spring type. Moreover, the complete and intimate contact of the vanes with the inner surface of the cam ring may be ensured at any angular position.

As described hereinbefore, according to the present invention, the complete contact of the vanes with the inner surface of the cam ring may be ensured at any angular position, the longer service life may be ensured, and the fluid leakage may be prevented so that the volumetric efficiency may be increased and the high efficiency operation may be ensured. Furthermore, the vane-type rotary machines in accordance with the present invention are simple in construction and inexpensive to manufacture.

What is claimed is:

1. In a vane-type rotary machine having a casing and a rotor therein, said rotor having an annular housing chamber formed in each side wall, seesaw members disposed in each of said chambers, means in said chambers for mounting said members for seesaw action, a plurality of radially disposed vane slots formed about the periphery of said rotor, a movable vane positioned in each of said slots, a guide hole formed between the bottom of each vane slot and each housing chamber, and a push rod closely and slidably mounted in each guide hole, the outer ends of said rods engaging the inner ends of said vanes and the inner ends of pairs of spaced apart rods respectively engaging opposite ends of said seesaw members.

2. A vane-type rotary machine as set forth in claim 1 wherein a spring is loaded between the outer end of said push rod and the bottom end of the vane.

3. A vane-type rotary machine as set forth in claim 1 wherein a spring is loaded between the push rod and the seesaw member.

4. A vane-type rotary machine as set forth in claim 1 wherein said seesaw members are in the form of a leaf or rod-shaped spring.

5. A vane-type rotary machine as set forth in claim 1 wherein said push rods are made of a resilient material.

6. A vane-type rotary machine as set forth in claim 1 wherein each of said seesaw members is supported through spring means so that the seesaw member biases its corresponding push rods upwardly.

7. A vane-type rotary machine as set forth in claim 1 wherein said push rod and its corresponding seesaw member are so arranged that the surface of contact therebetween is perpendicular to the axis of said push rod when the vane corresponding to said push rod is at the midpoint of a transition path of a cam ring between the large-diameter cam surface portion where said vane is pushed out of its vane slot and the small diameter cam surface portion where said vane is pushed into said vane slot.

8. A vane-type rotary machine as set forth in claim 1 wherein said seesaw members are rotatably supported by supporting pins which in turn are supported by a pair of plates which are disposed within said housing chamber and spaced apart from each other by a suitable distance and by one of said pair of plates closer to the inner side wall of said housing and said inner side wall.

9. a vane-type rotary machine as set forth in claim 8 wherein a spring is interposed between said push rod and its corresponding vane.

10. A vane type rotary machine as set forth in claim 7 wherein said push rod and its corresponding seesaw member are so arranged that the surface of contact therebetween is perpendicular to the axis of said push rod when the vane corresponding to said push rod is at the midpoint of a transition path of a cam ring between the large-diameter cam surface portion where said vane is pushed out of its vane slot and the small-diameter cam surface portion where said vane is pushed into said vane slot; and a spring is interposed between the push rod and its corresponding vane.

* * * * *